US005105701A

United States Patent [19]

Hall et al.

[11] Patent Number: 5,105,701

[45] Date of Patent: Apr. 21, 1992

[54] CLARINET MOUTHPIECE

[76] Inventors: Jerry Hall, 450 Centenary Ave., Cleveland, Tenn. 37311; Hans Zinner, Marktrodach, Fed. Rep. of Germany

[21] Appl. No.: 618,733

[22] Filed: Nov. 27, 1990

Related U.S. Application Data

[63] Continuation of Ser. No. 447,069, Dec. 7, 1989, abandoned.

[51] Int. Cl.[5] ..... G10D 9/02

[52] U.S. Cl. ..... 84/383 R

[58] Field of Search ..... 84/382, 383 R, 383 A

[56] References Cited

U.S. PATENT DOCUMENTS 2,368,556 1/1945 Maccaferri ..... 84/393 R 4,449,439 5/1984 Wells ..... 84/383 R

OTHER PUBLICATIONS

Brilhart trade advertisement, Chicago, Trade Show, Jul. 21-24, 1958, pp. 4-5 & 8-9.

*Primary Examiner*—L. T. Hix
*Assistant Examiner*—Howard B. Blankenship
*Attorney, Agent, or Firm*—Dowell & Dowell

[57] ABSTRACT

A mouthpiece for a clarinet wherein the facing over which the reed is attached and which extends around the opening in the mouthpiece is uniquely curved to vary the gap between the reed and the facing and wherein the bore, which is of a preferred length, is provided with a tapered A-frame bridge adjacent the sound baffle of the mouthpiece.

8 Claims, 1 Drawing Sheet

Fig. 1
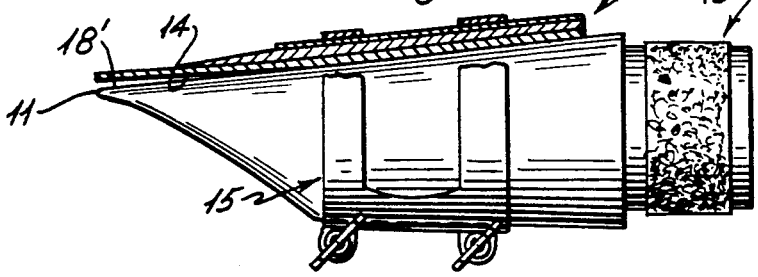
Fig. 2
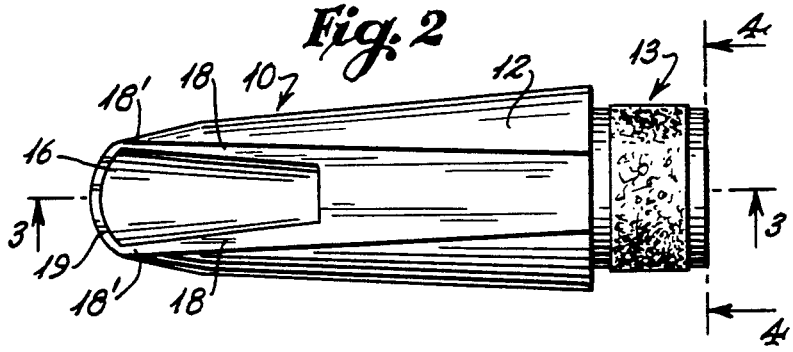
Fig. 3
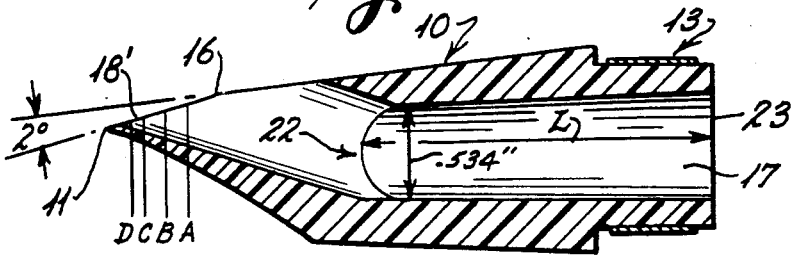
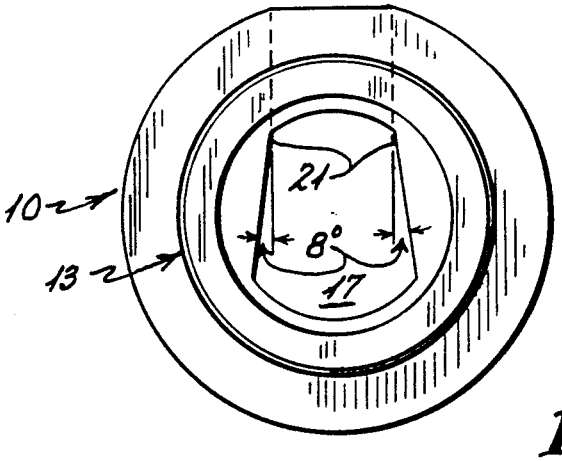
Fig. 4
Fig. 5
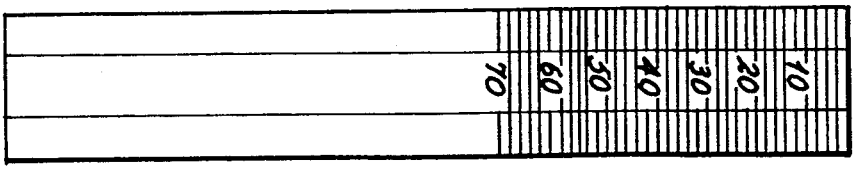

CLARINET MOUTHPIECE

This application is a continuation of application Ser. No. 07,447,069 filed Dec. 7, 1989, now abandoned.

BACKGROUND OF THE INVENTION

1. Field of the Invention

This invention is generally directed to mouthpieces for clarinets and more specifically to mouthpieces which have a specific facing configuration adjacent the tip of the mouthpiece so that the distance between the reed and the sound baffle opening of the mouthpiece is determined by a series of measured standardized gaps with the gaps being located at unique distances from the tip of the mouthpiece and further wherein the bore of the mouthpiece has a configuration and dimension which is such as to cooperate in a preferred embodiment, with the facing configuration so that the tonal as well as the playing characteristics of the mouthpiece are enhanced over conventional clarinet mouthpieces.

2. History of the Related Art

The clarinet, which was originated in the early 1700s, has continued to grow in popularity. As a member of the woodwind family of instruments, the clarinet includes a mouthpiece having a sound baffle opening and a bore. The mouthpiece is removably mounted to the tube or body of the clarinet so that the mouthpiece may be replaced as is necessary. A single flat cane reed is clamped over the sound baffle opening and vibrates to create sound when a player blows on the tip of the mouthpiece.

Since their origination, there have been numerous modifications made not only to the bodies of clarinets but also to the mouthpieces. Today, there remain structural differences between types of clarinets depending upon the country of origin. For instance, the bores associated with mouthpieces and bodies made in Germany are generally larger in dimension than the French-made clarinets which are generally used in the United States. Changing the physical characteristics of the clarinet body or mouthpiece results in a change in the tonal quality and playing techniques associated with each instrument.

During the early years of the clarinet it was proposed to channel the airflow entering the mouthpiece by providing inwardly extending vertical sidewalls on either side of the opening into the bore from the sound baffle of the mouthpiece. Over the years, this feature was removed from French clarinets so that today, such sidewalls or, A-frame bridges as they are otherwise referred to, are not conventional except in clarinets of the German type.

Designers and musical technicians are continuing in their efforts to improve upon the various physical characteristics of clarinet mouthpieces in an effort to achieve optimal tonal quality while making the mouthpieces more comfortable and compatible to musicians. In addition to changes in the bores of mouthpieces, the side rails which are associated with the facing of the mouthpieces have also been altered. Although not visible to the eye, the face of a mouthpiece for a clarinet and especially those of professional quality, are curved downwardly toward the tip of the mouthpiece thereby altering the gap or distance between the reed and the side and end rails of the mouthpiece which extend adjacent to the sound baffle opening into the mouthpiece. The surface contour of the mouthpiece is therefore defined in the art as having a given set of "facing numbers" or values which can be measured and which define the degree of curvature of the face of the mouthpiece. The "facing numbers" are associated with a specified scale or distance measurement which exists between the tip of the mouthpiece and points spaced inwardly of the tip at which the reed is spaced from the facing of the mouthpiece at specified distances.

In practice, the gap between the outer portion of the side rails increases toward the tip or end however the increase or arc is increased in steps. As a matter of standardized practice, four gap distances are normally utilized and are specified as 0.0015" or 0.038 mm, at a point most remote from the tip of the mouthpiece, with the gaps taken progressively closer to the tip being 0.010" or 0.254 mm, 0.020" or 0.508 mm and 0.022" or 0.559 mm. Further, the resultant tip distance or vertical distance between the tip of the mouthpiece and the reed will also vary. For instance, in many conventional clarinet mouthpieces used in the United States, the tip distance is measured as being 0.102" or 2.591 mm.

Most conventional tip distances range between approximately 0.102" or 2.591 mm and 0.120" or 3.05 mm. The curvature of the mouthpiece face is defined by four facing numbers measured by special measuring tools or scales. In the United States, the conventional scale is known as an "ERICK BRAND" measuring glass or scale. The scale includes an elongated flat bar upon which a scale extends from one end with the scale being measured in increments up to 70 (see FIG. 5 of the drawings). When the leading edge of the scale or measuring glass is aligned with the outer most edge of the tip of the mouthpiece, the scale will reflect a series of facing numbers 0–70 each of which is spaced at a different distance from the tip of the mouthpiece. To properly measure the spaced gaps of the side rails relative to the reed mounted in overlying relationship thereto, a conventional gapping gauge or feeler gauge is positioned between the side rails and the reed with the innermost edge of the gauge being aligned with the appropriate facing number of the scale. On a conventional mouthpiece the facing numbers measured toward the tip in four steps are 38, 23, 12 and 6. The gap spacing at each of the facing numbers as measured by the "ERICK BRAND" measuring glass are 0.0015" (0.038 mm), 0.010 (0.254 mm), 0.020" (0.508 mm) and 0.022" (0.559 mm), respectively.

Over the years, it has been the practice of many professional clarinetists to alter the facing numbers associated with the mouthpiece in order to change the playing characteristics of the mouthpiece, most mouthpieces, however, are not found to be uniformly acceptable. In addition, it has not been appreciated that the configuration of the entrance to the bore of the mouthpiece of a clarinet can also be configured and the bore length altered so as to uniquely benefit the tonal quality of the instrument and especially when such alterations are made in addition to selecting specific facing numbers that make the mouthpiece easier to use.

SUMMARY OF THE INVENTION

This invention is directed to a mouthpiece for clarinets which includes specifically tapered side rails along the face of the mouthpiece so that a series of gap distances is created between the reed and the face along the tip portion of the mouthpiece which gap distances and relative spacings therebetween define the downward curvature of the mouthpiece facing. There are four points of measurement with the innermost taper having a gap of approximately 0.0015", 0.038 mm, with the distance to the tip being measured at approximately 38 on an "ERICK BRAND" measuring glass. The second facing number as measured on the "ERICK BRAND" measuring glass at approximately 26 with a gap distance of approximately 0.010" or 0.254 mm. The third and fourth facing numbers as measured by the "ERICK BRAND" measuring glass are 16 and 10 with gap distances being approximately 0.020" or 0.508 mm and 0.022" or 0.559 mm, respectively. The face should therefore define a curve wherein the gap distances are created at the specified facing numbers.

In addition to the facing numbers of the present invention which result in a unique curved taper to the face of the mouthpiece, the present invention also includes a unique bore length which is generally equal to approximately 2.075" or 52.705 mm. In the preferred embodiment the diameter of the mouthpiece will taper outwardly from adjacent the sound baffle toward the connector portion of the mouthpiece. The taper is from approximately 0.534" or 13.564 mm to 0.585" or 14.859 mm.

To add further unique tonal qualities to the preferred embodiment of the invention, the entrance into the bore of the mouthpiece is defined by an A-frame bridge which includes opposing vertical side walls which taper outwardly from top to bottom at an angle of approximately 8 degrees with respect to a vertical plane.

It is a primary object of the present invention to provide a mouthpiece for clarinets which includes a unique set of facing numbers which define the arcuate configuration of the face relative to a reed mounted in overlying relationship with respect to the sound baffle of the mouthpiece so that the tonal quality of the clarinet is not only improved but the sound projection is also altered thereby providing a deeper tonal quality and softer sound. Further, the mouthpiece of the present invention provides a unique set of facing numbers which makes the mouthpiece more comfortable and easier to play as well as to facilitate the mounting of reeds to the mouthpiece.

It is a further object of the present inventions to provide a mouthpiece for clarinets which not only includes a unique set of facing numbers for locating the gap distances between the reed and the face of the mouthpiece but which also cooperates with a uniquely designed bore of specified length so that the combination of the facing numbers and the bore length result in a unique tonal quality for such instruments.

It is another object of the present invention to provide a mouthpiece which includes a unique set of facing numbers which locates the gap distances between the reed and the face of the mouthpiece adjacent to the sound baffle and which further includes a uniquely dimensioned bore but which further includes an A-frame bridge at the entrance to the bore of the mouthpiece which includes vertically tapered side walls which cooperate to further affect the tonal qualities achieved to provide optimum sound projection for the instrument.

BRIEF DESCRIPTION OF THE DRAWINGS

FIG. 1 is a side elevational view of a mouthpiece for a clarinet in accordance with the present invention.

FIG. 2 is a top plan view of the clarinet mouthpiece of the present invention with the reed not being mounted thereto.

FIG. 3 is a cross-sectional view taken along line 3—3 of FIG. 2.

FIG. 4 is a view taken along lines 4—4 of FIG. 2.

FIG. 5 is a top plan view of an "ERICK BRAND" measuring glass used to make measurements with respect to the facing numbers of the mouthpiece of the invention.

DESCRIPTION OF THE PREFERRED EMBODIMENT

With continued reference to the drawings, the clarinet mouthpiece 10 of the present invention is shown as including a tip portion 11, face portion 12 and connector sleeve 13. A single reed 14 is secured to the mouthpiece by one or more brackets 15 so as to be in overlying relationship to the opening or sound baffle 16 which communicates with the bore 17 of the mouthpiece, as is shown in FIG. 3. With reference to FIG. 2, the facing includes a pair of side rails 18 and an end rail 19 which border the opening 16 into the mouthpiece. The outer segment 18' of the side rails 18 are curved or inclined downwardly with the degree of curvature being defined by four facing numbers which are located in space relationship with respect to the tip 11. The downward curvature of the face results in a progressively wider gap being formed between the face and the reed.

As was previously discussed, the relative curvature of the face is measured by four different gaps and their relative positioning to one another and the tip of the mouthpiece. The innermost gap distance is standardized at 0.0015" or 0.038 mm; the second gap distance is standardized at 0.010" or 0.254 mm; the third gap distance is standardized at 0.020" or 0.508 mm and the fourth gap distance is standardized at 0.022" or 0.559 mm. Although the gap distances are standardized the points at which these distances between the face and the reed are located along the length of the face of the mouthpiece varies. The positions are defined, in the United States, by a linear scale which is referred to as an "ERICK BRAND" measuring glass (see FIG. 5) which provides a uniform measurement of each gap relative to the tip of the mouthpiece. Each location at which one of the gaps is established is referred to as a facing number read from the "ERICK BRAND" scale.

It has been determined that by altering the facing numbers from conventional facing numbers, the tonal and playing characteristics of the clarinet may be universally enhanced. More specifically, the present invention increases the face numbers over conventional mouthpieces and also provides a greater tip opening 20 as compared with conventional mouthpieces The tip opening is measured between the tip of the reed 14 and the tip 11 of the mouthpiece. With the invention, the face numbers, based upon an "ERICK BRAND" measuring glass, are 38, 26, 16 and 10, such numbers being measured relative to the tip of the mouthpiece and being indicated at A, B, C and D in the drawings. Therefore, using a gapping tool, the gap at A between the face of the mouthpiece and the reed is approximately 0.0015" or 0.0381 mm; the gap at B is approximately 0.010" or 0.254 mm; the gap at C is approximately 0.020" or 0.508 mm; and the gap at D is approximately 0.022" or 0.559 mm. The tip opening, in the preferred embodiment, is approximately 0.128" or 3.25 mm. The facing numbers described are optimum and preferably should not be varied, plus or minus, more than one number on the "ERICK BRAND" scale. Utilizing the specified facing numbers and the gap distances, the curvature obtained is generally defined by a radius of 6.250" or 158.750 mm.

Utilizing the facing numbers disclosed above, it has been found that the clarinet mouthpiece is easier to play and results in increased sound projection for the instrument.

In addition to the foregoing, the present invention also is directed to varying the configuration of the bore associated with the mouthpiece for a clarinet. With specific reference to FIG. 4 of the drawings, it is noted that the entrance to the bore from the sound baffle is defined by a pair of inwardly extending and vertically oriented wall segments 21 which taper outwardly from top to bottom of the bore at an angle of approximately eight degrees with respect to a vertical plane. The minimum width defined between the two wall segments is approximately 0.158" or 4.013 mm as measured at the top of the bore. The two wall segments define an A-frame bridge for introducing airflow into the bore of the mouthpiece.

Due to the provision of the A-frame bridge at the opening 22 of the bore in the mouthpiece, the length of the mouthpiece is also altered with respect to conventional mouthpiece bores. In the present invention, it has been determined that the effective length of the bore as shown as length L in FIG. 3 is 2.075" or 52.705 mm. It is envisioned that this length should not be altered and is accurate within at least 1/100th of an inch. With the configuration and length of the bore, the tonal qualities achieved for a clarinet are deeper and softer than when conventional mouthpieces are used. To further facilitate the tonal qualities developed by the mouthpiece of the present invention, the bore may be tapered from the inner end thereof 22 to the outermost end thereof 23. In the preferred embodiment, the bore tapers from approximately 0.534" or 13.564 mm adjacent to the A-frame bridge to 0.585" or 14.859 mm adjacent the second or outer end of the bore.

In the preferred embodiment of the invention, not only are the facing numbers incorporated within the mouthpiece for the clarinet but also the A-frame bridge is utilized together with the specified length of bore. As an alternate embodiment, the bore may be tapered as discussed above to further enhance the overall tonal qualities which may be developed by the mouthpiece. Again, the ease of playing utilizing the mouthpiece of the present invention as well as the tonal qualities developed provide a significant advantage over conventional mouthpieces. The mouthpiece of the present invention may be utilized in place of conventional mouthpieces on clarinets by simply substituting the mouthpiece for the existing mouthpiece associated with such clarinets.

The dimensions of the mouthpiece set out above are optimum and any deviations should not exceed approximately 0.005" or 0.127 mm.

We claim:

1. In a mouthpiece for a clarinet which includes a tip, a face extending inwardly from the tip, an opening in the face adjacent of the tip and a longitudinal bore communicating with the opening, and wherein the face is arcuately curved downwardly toward the tip with such curvature being defined by a set of four facing numbers as read from an "ERICK BRAND" measuring glass which numbers indicate the gap distance between the face and a reed which may be selectively mounted to the mouthpiece in overlying relationship to the opening and the tip of approximately 0.038 mm, 0.254 mm, 0.508 mm and 0.559 mm, respectively, the improvement comprising, said facing numbers being approximately 38, 26, 16, 10 respectively, said bore having an inner end and an outer end, the length of said bore between such inner and outer end being approximately 52.705 mm, and said inner end including a pair of inwardly extending and vertically oriented side walls, and side walls being inclined outwardly from top to bottom.

2. The mouthpiece of claim 1 in which said side walls are inclined at an angle of approximately 8 degrees with respect to a vertical plane.

3. The mouthpiece of claim 2 in which said tops of said side walls are spaced approximately 4.013 mm with respect to one another.

4. The mouthpiece of claim 2 in which the diameter of the bore adjacent said inner end is approximately 13.564 mm and the diameter adjacent said outer end is approximately 14.859 mm.

5. The mouthpiece of claim 1 in which the diameter of the bore adjacent said inner end is approximately 13.564 mm and the diameter adjacent such outer end is approximately 14.859 mm.

6. In a mouthpiece for a clarinet which includes a tip, a face extending inwardly from the tip, an opening in the face adjacent the tip and a longitudinal bore communicating with the opening, and wherein the face is arcuately curved downwardly toward the tip, the improvement comprising the bore having inner and outer ends, said inner end including a pair of inwardly extending and vertically oriented side walls, said side walls being inclined outwardly from top to bottom, said bore having a length of approximately 52.705 mm, said bore tapering outwardly from adjacent said inner end to said outer end, said bore having a diameter adjacent said inner end of approximately 13.564 mm and the diameter adjacent said outer end being approximately 14.859 mm.

7. The mouthpiece of claim 6 in which said side walls are inclined at an angle of approximately 8 degrees with respect to a vertical plane.

8. The mouthpiece of claim 7 in which said tops of said side walls are spaced approximately 4.013 mm with respect to one another.

* * * * *